United States Patent [19]

Suzuki et al.

[11] Patent Number: 4,755,443

[45] Date of Patent: Jul. 5, 1988

[54] PHOTORECEPTOR FOR ELECTROPHOTOGRAPHY COMPRISING A PHTHALOCYANINE AND ORGANIC AMINE COMPOUND

[75] Inventors: Yasuo Suzuki; Yoshihide Fujimaki; Hiroyuki Nomori, all of Hachioji, Japan

[73] Assignee: Konishiroku Photo Industry Co., Ltd., Tokyo, Japan

[21] Appl. No.: 924,349

[22] Filed: Oct. 28, 1986

[30] Foreign Application Priority Data

Oct. 31, 1985 [JP] Japan ..... 60-242882

[51] Int. Cl.[4] ..... G03G 5/06; G03G 5/14

[52] U.S. Cl. ..... 430/58; 430/59; 430/78; 430/83

[58] Field of Search ..... 430/59, 58, 78, 83

[56] References Cited

U.S. PATENT DOCUMENTS

| | | | |
|---|---|---|---|
| 3,708,293 | 1/1973 | Brach et al. | 430/78 |
| 4,088,507 | 5/1978 | Tanaka et al. | 106/288 Q |
| 4,563,408 | 1/1986 | Lin et al. | 430/59 |

*Primary Examiner*—J. David Welsh

*Attorney, Agent, or Firm*—Jordan B. Bierman

[57] ABSTRACT

Disclosed is a photoreceptor for electrophotography comprised of a charge carrier generating material and charge transport material wherein one charge generating material is a metal phthalocyanine or a metal-free phthalocyanine. The layer containing the generator material also contains an organic amine.

18 Claims, 3 Drawing Sheets

PHOTORECEPTOR FOR ELECTROPHOTOGRAPHY COMPRISING A PHTHALOCYANINE AND ORGANIC AMINE COMPOUND

FIELD OF THE INVENTION

The present invention relates to a photoreceptor for electrophotography and, more particularly, to a photoreceptor intended for use with printers and copying machines and having high sensitivity to light of wavelengths longer than visible rays and to semiconductor laser beams.

BACKGROUND OF THE INVENTION

Hitherto, photoreceptors for electrophotography having high sensitivity to visible light have been widely used with copying machines, printers, and the like.

Gallium-aluminum-arsenic (Ga.Al.As)-based light emitting devices which are widely used as semiconductor lasers emit radiation at a wavelength of about 750 nm or more. With a view of obtaining a photoreceptor having high sensitivity to radiation of such long wavelength, various attempts have hitherto been made. For example, there has been proposed an idea that a sensitizer for effecting a wavelength increase is added to photosensitive materials, such as Se and CdS, which have high sensitivity to light of a visible ray-wave range; but this idea has a difficulty that Se or CdS has no sufficient resistance to such environmental factors as temperature and humidity. Many known organic photoconductive materials are usually limited in sensitivity to a visible-ray wave range of less than 700 nm. Indeed, few of them, if any, have good sensitivity to longer wave ranges.

Of those organic photoconductive materials, phthalocyanine compounds are known as having extended spectral photosensitivity as compared with other organic photoconductive materials. Further, in the process of $\alpha$-type phthalocyanine compounds being transformed into $\beta$-type phthalocyanine compounds having a stable crystal form, varieties of phthalocyanine compounds in different crystal forms have been found out. Among these photoconductive phthalocyanine compounds are, for example, X-type metal-free phthalocyanine compounds mentioned in Japanese Examined Patent Publication No. 49-4338, and $\gamma$-, $\gamma'$, $\eta$-, and $\eta'$-type metal-free phthalocyanine compounds mentioned in Japanese Unexamined Patent Publications Nos. 58-182639 and 60-19151.

However, photoreceptors using these metal free phthalocyanine compounds have considerable memory effect and have not yet been found to be useful for practical application. As a matter of fact, few photoreceptors having sufficient sensitivity to long wavelength light and semiconductor laser beam and well qualified for practical use have been known, and there has been strong demand for development of such improved photosensitive material.

SUMMARY OF THE INVENTION

Accordingly, the primary object of this invention is to provide a photoreceptor which involves less memory effect and which is suitable for use with long-wavelength light or semiconductor laser beam.

In order to accomplish this objective, the invention provides a photoreceptor for electrophotography having a carrier generating layer which includes a carrier generating substance, characterized in that said carrier generating substance contains a metallic phthalocyanine compound and/or a metal-free phthalocyanine compound, and in that said carrier generating layer contains an organic amine in an amount of less than 2.0 times the number of moles of said carrier generating substance.

Figure 1:
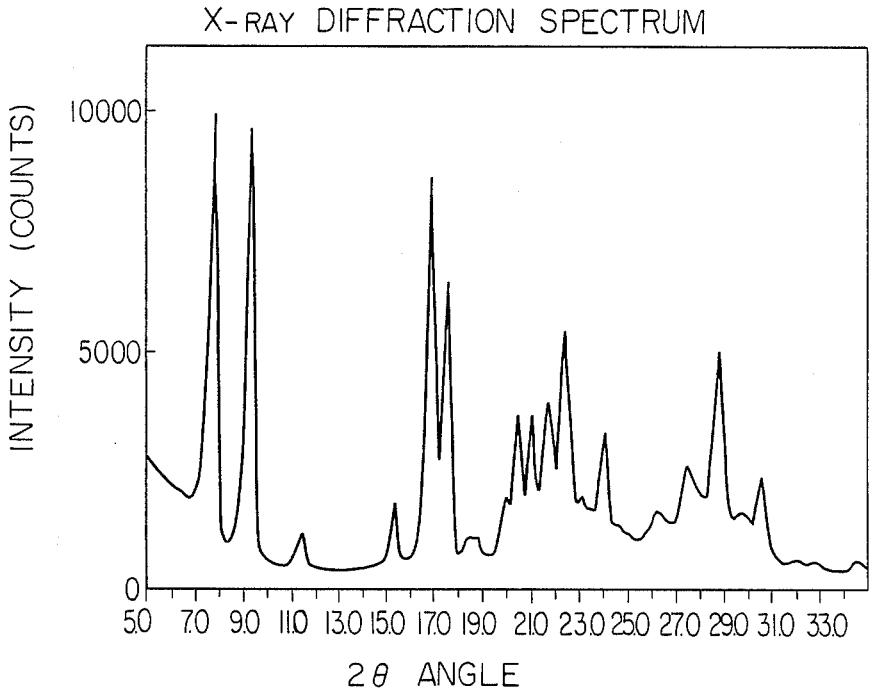
FIG. 1 is an X-ray spectrum of a metal-free phthalocyanine compound used for the purpose of the invention.

In the drawings, reference numeral 1 is an electroconductive substrate; 2 is a carrier generating layer; 3 is a carrier transport layer: 4, 4', 4'' are photoreceptor layer; 5 is an intermediate layer; 6 is a carrier generating substance; and 7 is a carrier transport substance.

DETAILED DESCRIPTION OF THE INVENTION

Phthalocyanine compounds useful for the purpose of the invention include both metal-free phthalocyanine compounds and metallic phthalocyanine compounds. For example, metal-free phthalocyanine compounds, of $\alpha$-, $\beta$-, $\gamma$-, $\tau$-, $\tau'$-, $\eta$-, $\eta'$-, X-types and copper phthalocyanine compounds of $\epsilon$-type are mentioned as such. Of these, $\tau$-, $\tau'$- , $\eta$-, n'-, X-type metal-free phthalocyanine compounds and $\epsilon$-type copper phthalocyanine compounds are preferred. The metal-free phthalocyanine compounds are advantageous in that they have high sensitivity and good charging stability. Several characteristic aspects of the preferred metal-free phthalocyanine compounds are shown in Table 1.

TABLE 1

| Crystal - form | Bragg angle to X ray of CuK $\alpha$ 1.541 Å | Infrared spectrum (Number denotes wave number in $cm^{-1}$ |
|---|---|---|
| $\tau$ | 7.6, 9.2, 16.8, 17.4, 20.4, 20.9 | Between 700~760: 4 absorption bands of which one at 751 ± 2 is most intense; 2 absorption bands between 1320~1340; one characteristic absorption band at 3288 ± 3. |
| $\tau'$ | 7.5, 9.1, 16.8, 17.3, 20.3, 20.8, 21.4, 27.4 | 4 absorption bands of which one at 753 ± 2 is intensemost between 700~760: 2 absorption bands between 1320~1340; one characteristic absorption band at 3297 ± 3. |
| X | 7.5, 9.1, 16.7, 17.3, 22.3 | 3 absorption bands of which one at 764 is intensemost between 700~750; absorption bands of same intensity at |

TABLE 1-continued

| Crystal - form | Bragg angle to X ray of CuK α 1.541 Å | Infrared spectrum (Number denotes wave number in $cm^{-1}$ |
|---|---|---|
| | | 1318, 1330. |
| η | Some species show strong peaks at 7.6, 9.2, 16.8, 17.4, 28.5; some others show a strong peak at 7.6, 9.2, 16.8, 17.4, 21.5, 27.5. | 4 absorption bands of which one at 753 ± 1 is intensemost between 700~760; 2 absorption bands between 1320~1340; one characteristic absorption band at 3285 ± 3. |
| η' | Some species show strong peaks at 7.5, 9.1, 16.8, 17.3, 20,3, 20.8, 21.4 and 27.4; some others show strong peaks at 7.5, 9.1, 16.8, 17.3, 20.3, 20.8, 21.4, 22.1, 27.4, and 28.5 | 4 absorption bands of which one at 753 ± 1 is intensemost between 700~760; 2 absorption bands between 1320~1340; one characteristic absorption band 3297 ± 3. |

These metal-free phthalocyanine compounds are mentioned in detail in Japanese Examined Patent Publication No. 49-4338, Japanese Unexamined Patent Publication No. 60-19154, and Japanese Unexamined Patent Publication No. 58-182639. Copper phthalocyanines of ε-type are mentioned in Japanese Examined Patent Publication No. 40-2780.

Figure 3:
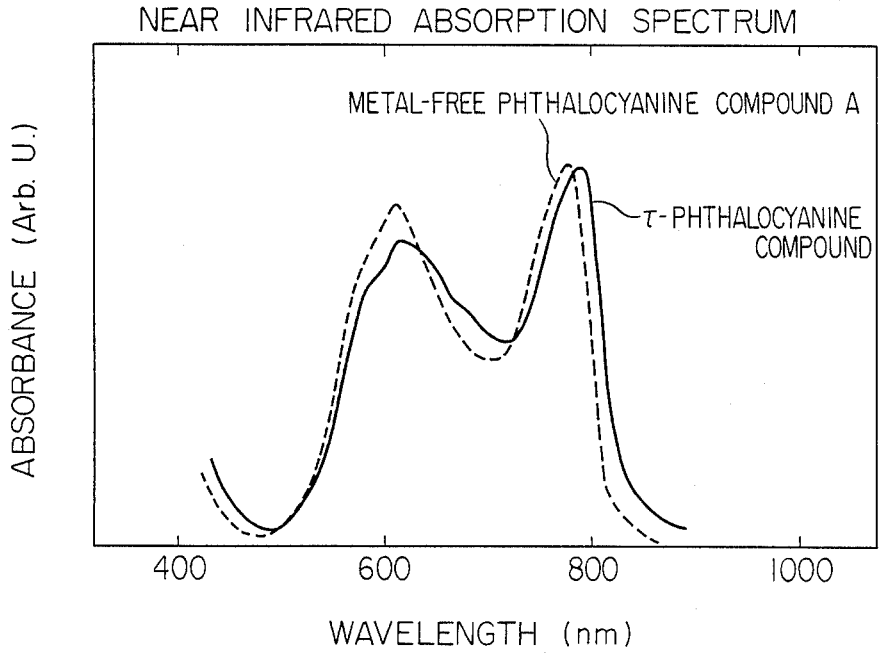
FIG. 3 is a near-infrared absorption spectrum of the phthalocyanine compound.
Figure 2:
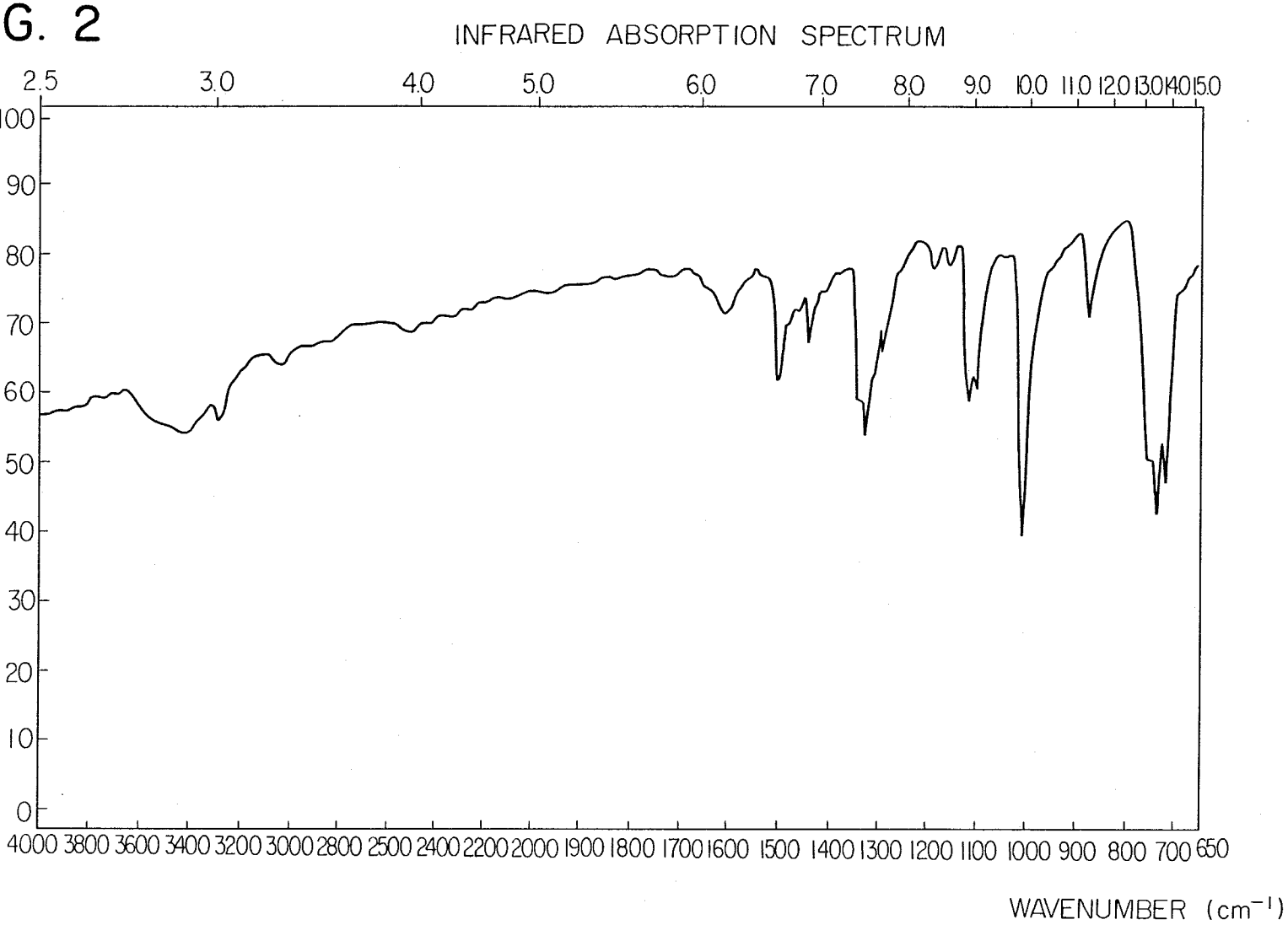
FIG. 2 is an infrared absorption spectrum thereof.

Among metal-free phthalocyanine compounds those having the following characteristics can be advantageously used for the purpose of the invention: that is, as FIG. 1 shows, their diffraction spectrum is such that there are main peaks at the following Bragg angles (error $2\theta \pm 0.2°$) to X-radiation of CuK α1.541 Å: 7.7, 9.3, 16.9, 17.6, 22.4, 22.8, the intensity ratio of the peak at Bragg angle 16.9 to the peak at Bragg angle 9.3 being 0.8~1.0, the respective peaks at Bragg angles 22.4 and 28.8 being in the intensity ratio of more than 0.4 to the peak at Bragg angle 9.3; that as FIG. 2 shows, their infrared spectrum is such that between 700~760 $cm^{-1}$ there are four absorption bands of which one at 720±2 $cm^{-1}$ is most intense and such that there are characteristic absorption bands at 1320±2 $cm^{-1}$ and 3288±3 $cm^{-1}$; and that as FIG. 3 shows, the absorption peak in their visible and near infrared absorption spectrum is more than 770 nm but less than 790 nm. Such metal-free phthalocyanine compound has a stble crystal form and is not liable to transition in crystal form even when it is steeped in organic solvents, such as acetone, tetrahydrofuran, toluene, ethyl acetate, and 1,2-dichloroethane, or when it is allowed to stand for 50 hours at 200° C., for example, or when it is exposed to mechanical strain by milling, for example. Such compound also provides good potential stability for repeated use of the photosensitive material.

According to the present invention, other carrier generating substances may be used in combination with any of the abovementioned phthalocyanine compounds. Specific examples of such other carrier generating substance will be given hereinafter. In accordance with the invention, an organic amine is added to the carrier generating substance, in an amount of not more than twice the number of moles of the latter. Examples of such organic amine are primary amines, such as monoethanol amine, ethylenediamine, isopropylamine, octylamine, methylamine, ethylamine, cyclohexyl amine, tert-butyl amine, sec-butyl amine, n-butyl amine, n-amyl amine, propylamine, and n-heptyl amine, secondary amines, such as diethanol amine, diethylamine, piperidine, di-n-propyl amine, dimethylamine, dihexylamine, didodecylamine, di-1-butyl amine, di-1-amylamine, di-octyl amine, di-cyclohexyl amine, di-amyl amine, di-n-butyl amine, and di-isopropyl amine; and tertiary amines, such as tripropylamine, triethylamine, n-tributyl amine, triamylamine, and triethanolamine. Heterocyclic amines, such as pyridine and the like, may also be used. Of these amines, those having a boiling point of 80° C. or more are preferred. More specifically, the secondary and tertiary amines are preferred.

Such organic amine is added in an amount of not more than 2.0 times, preferably not more than 0.2 times, the number of mole of the carrier generating substance used. Inasmuch as the addition is limited to such reasonable extent, when a coating liquid of the carrier generating substance is prepared, the substance can be held in dispersion in the coating liquid without being dissolved, so that the crystal form of the substance may be kept intact. Thus, improved photosensitivity and improved potential stability to dark decay and to repeated use can be obtained.

If the amount of the organic amine is in excess of 2.0 times the number of moles of the phthalocyanine compound, the problem of odor will arise when a carrier generating layer for a photosensitive material is formed of the coating liquid, and in addition there may arise problems, such as surface tackiness present after the coating is dried, and changes in the crystal-line state of the carrier generating substance due to possible dissolution of the substance. If the amount of the organic amine is less than 0.001 mole, no sufficient effect thereof can be obtained.

Such organic amine compound is strongly adsorbed by the phthalocyanine compound used in accordance with the invention.

To form a carrier generating layer for a photosensitive material which contains an organic amine in combination with a metal phthalocyanine compound and/or metal-free phthalocyanine compound, a coating liquid which contains such organic amine is coated on a specified substrate and the resulting composite is dried. Alternatively, without the organic amine being included in the carrier generating layer, the former is added to a coating liquid for forming another layer, or a carrier transport layer, which is placed on the carrier generating layer, whereby the organic amine is included in said another layer, so that the organic amine may be caused to diffuse from the carrier transport layer for migration to the carrier generating layer. In order to prepare aforesaid coating liquid which contains the organic amine, one applicable method is that 1/2000~1/20000 by volume ratio of the organic amine is added to a solvent (which quantity corresponds to less than 0.5 ml but more than 0.05 ml relative to 1000 ml of the solvent in the coating liquid, in which case, for example, the molecular weight of the carrier generating substance may be 500, the molecular weight of the amine may be 100, and the concentration of the fluid dispersions may be 1.0 wt%), the carrier generating substance being then dispersed into the solution, which solution may contain such binder resin as will be described hereinafter, as required, whereby the coating liquid can be prepared. Another applicable method is such that the organic amine is incorporated into dispersions of the carrier generating substance.

It is also possible to bring a carrier generating layer, after it is formed, into contact with an amine atmosphere only for a specified period of time, thereby causing the amine to diffuse into the carrier generating layer.

As carrier generating substances available for use in combination with the metal phthalocyanine compounds and/or metal-free phthalocyanine compounds of the invention may be mentioned azo-pigments, anthroquinone dyes, perylene dyes, polycyclic quinone dyes, and methine-stearate pigments. Of these, azo-pigments and anthroquinone dyes are most preferred.

As carrier transprot substances available for use in the electrophotosensitive material of the invention may be mentioned oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, and poly-9-vinylanthracene.

More specifically, styryl compounds having the following general formula [II] or [III] may be mentioned:

General formula [II]

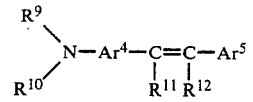

(wherein, $R^9$, $R^{10}$: independently represent a substituted or unsubstituted alkyl or aryl group; substituent is selected from alkyl, alkoxy, substituted amino, hydroxyl group, halogen atom, and aryl group;

$Ar^4$, $Ar^5$: independently represent a substituted or unsubstituted aryl group; substituent is selected from alkyl, alkoxy, substituted amino, hydroxyl group, halogen atom, and aryl group;

$R^{11}$, $R^{12}$: independently represent a substituted or unsubstituted aryl group or a hydrogen atom; substituted is selected from alkyl, alkoxy, substituted amino, hydroxyl group, halogen atom, and aryl group.)

General formula [III]:

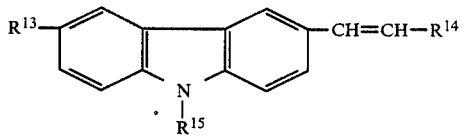

(wherein, $R^{13}$: represents a substituted or unsubstituted aryl group;

$R^{14}$: represents a hydrogen atom, a halogen atom, a substituted or unsubstituted alkyl group, an alkoxy group, an amino group, a substituted amino group, or a hydroxyl group;

$R^{15}$: represents a substituted or unsubstituted aryl group, or a substituted or unsubstituted heterocyclic group.)

Examples of styryl compounds having aforesaid general formula [II] or [III] are given below:

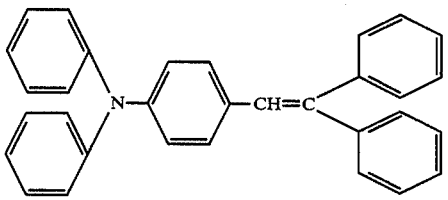

(II-1)

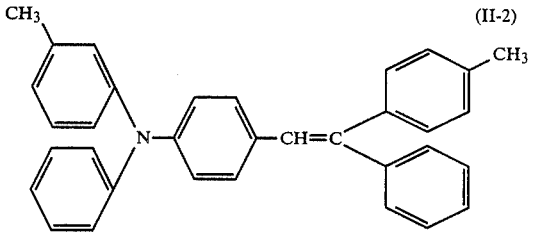

(II-2)

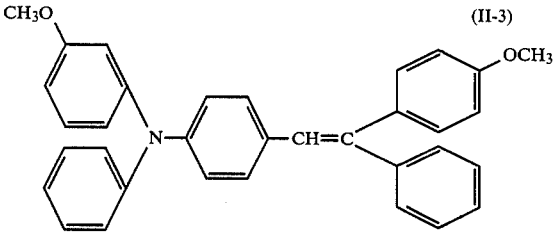

(II-3)

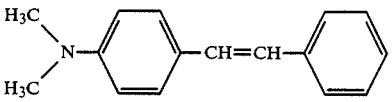

(II-4)

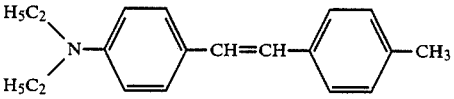

(II-5)

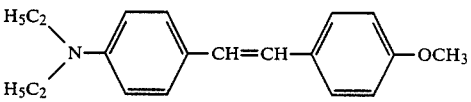

(II-6)

-continued
(II-7)
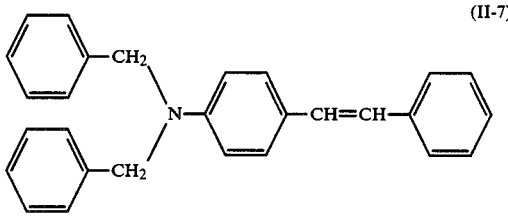
(II-8)
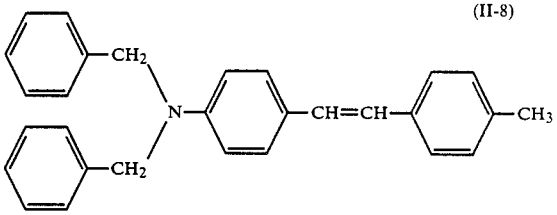
(II-9)
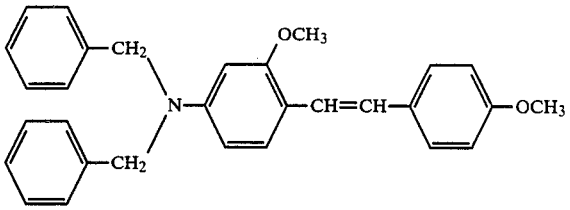
(II-10)
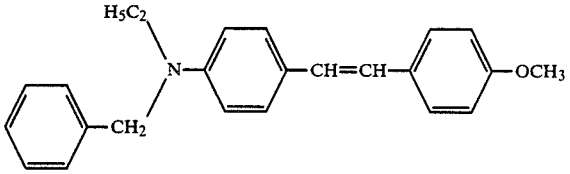
(II-11)
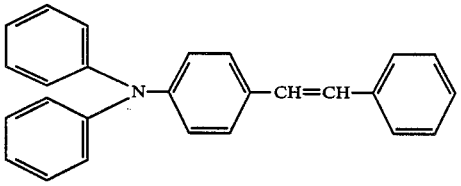
(II-12)
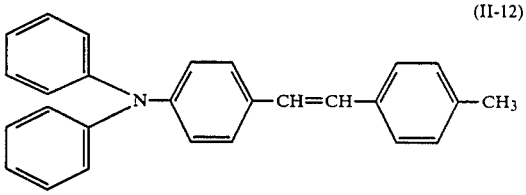
(II-13)
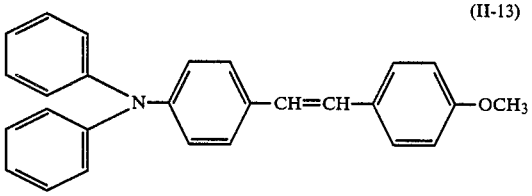
(II-14)
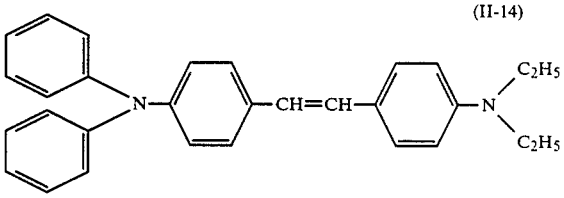
(II-15)
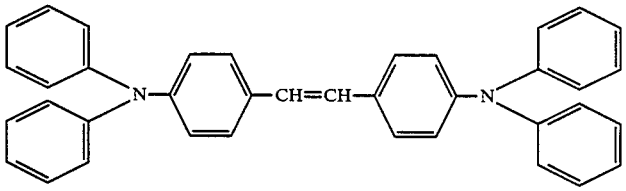
(II-16)
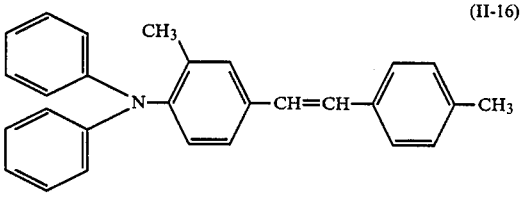
(II-17)
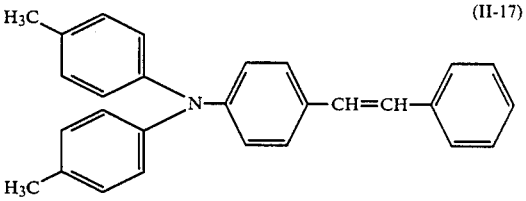

-continued
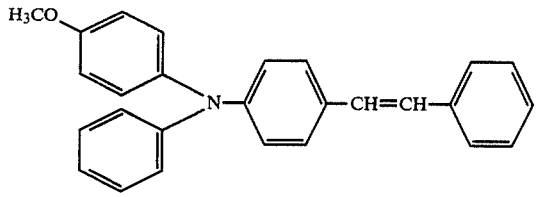
(II-18)
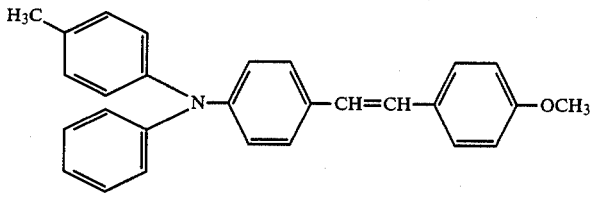
(II-19)
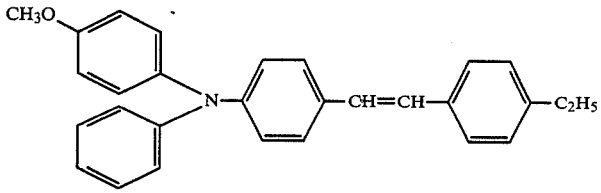
(II-20)
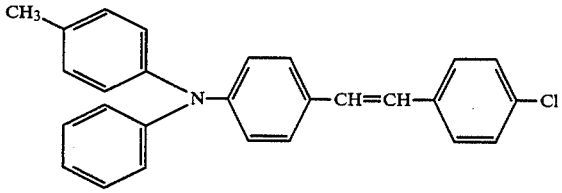
(II-21)
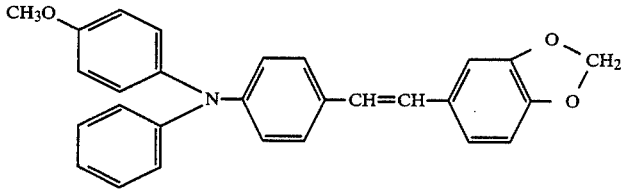
(II-22)
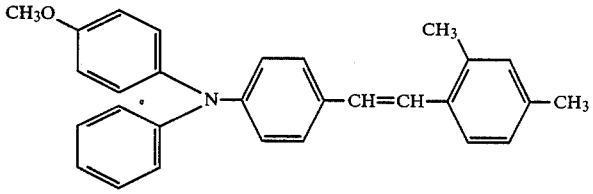
(II-23)
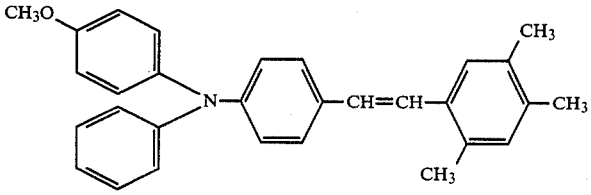
(II-24)

-continued
(II-25)
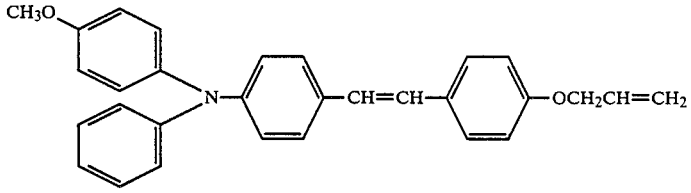
(II-26)
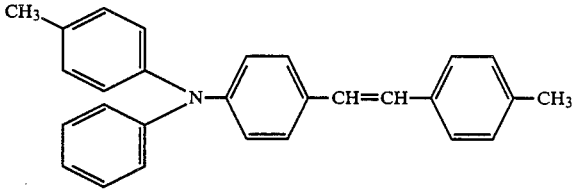
(II-27)
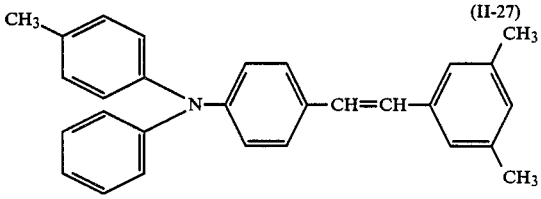
(II-28)
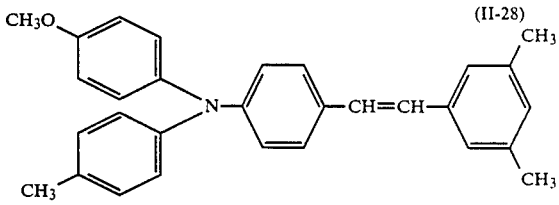
(II-29)
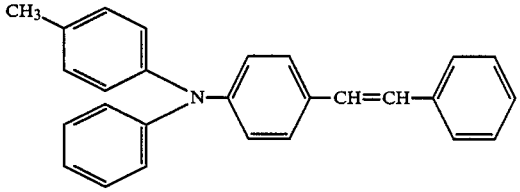
(II-30)
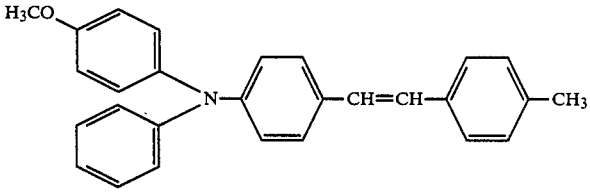
(III-1)
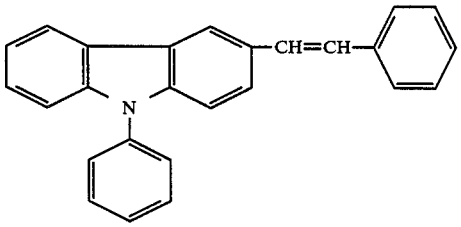
(III-2)
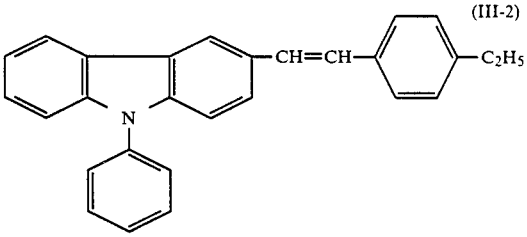
(III-3)
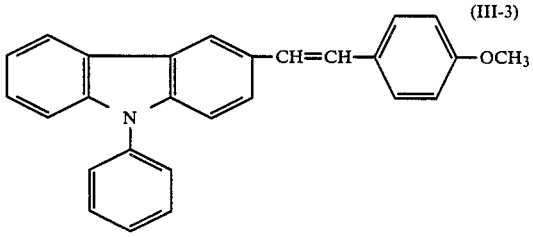
(III-4)
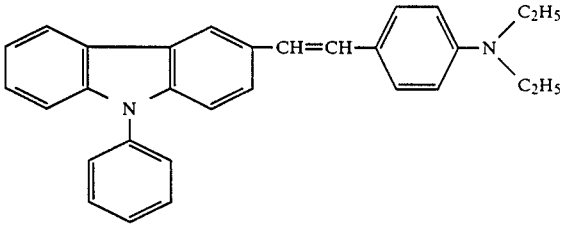

-continued (III-5)

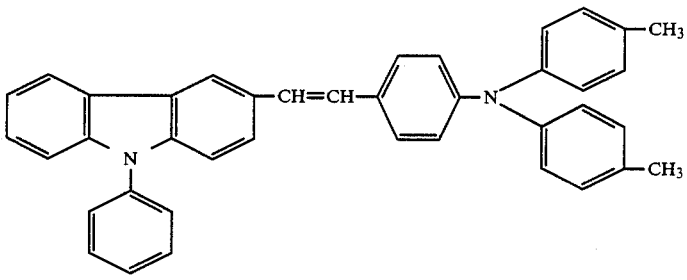

(III-6)

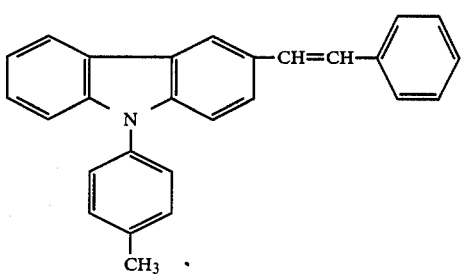

(III-7)

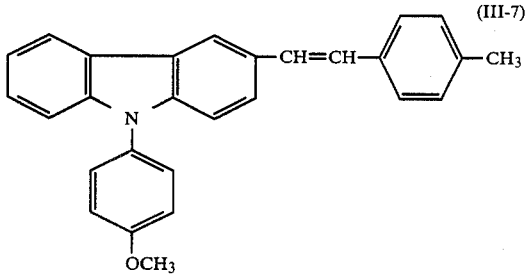

(III-8)

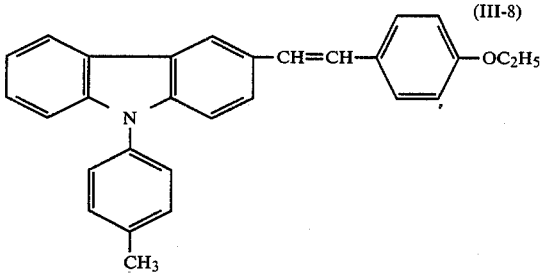

(III-9)

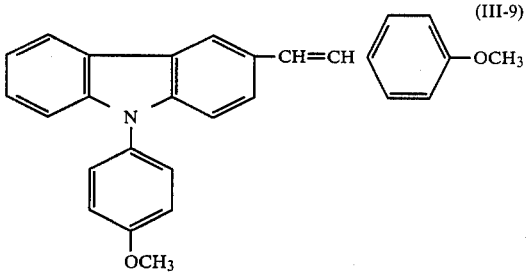

(III-10)

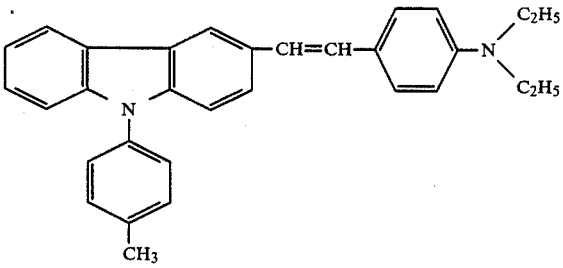

(III-11)

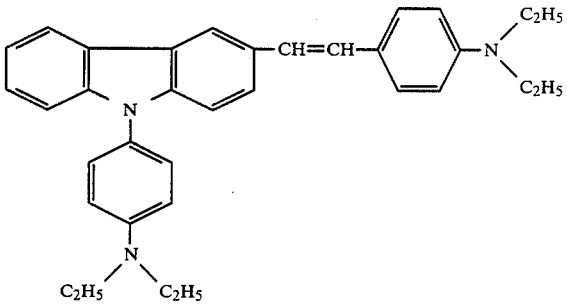

Hydrazone compounds having the following general formula [IV], [V], [VI] or [VII] may also be used as carrier transport substances:

General formula [IV]:

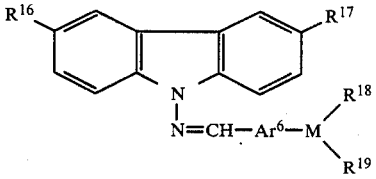

(wherein, $R^{16}$ and $R^{17}$: independently represent hydrogen or halogen atom;

$R^{18}$ and $R^{19}$: independently represent substituted or unsubstituted aryl group;

$Ar^6$: represents a substituted or unsubstituted aryl group.)

General formula [IV]:

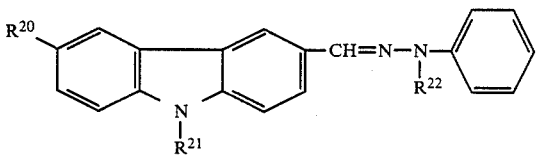

(wherein, $R^{20}$: represents a methyl, ethyl, 2-hydroxyethyl, or 2-chloro-ethyl group;

$R^{21}$: represents a methyl, ethyl, benzyl, or phenyl group;

$R^{22}$: represents a methyl, ethyl, benzyl, or phenyl group.)

General formula [VI]:

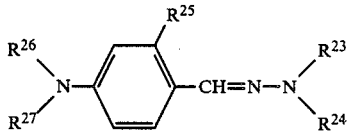

(wherein, $R^{23}$: represents a substituted or unsubstituted naphtyl group;

$R^{24}$: represents a substituted or unsubstituted alkyl, aralkyl, or aryl group;

$R^{25}$: represents a hydrogen atom, or an alkyl or alkoxy group; and $R^{26}$ and $R^{27}$: independently represent substituted or unsubstituted alkyl, aralkyl, or aryl group.)

General formula [VII]:

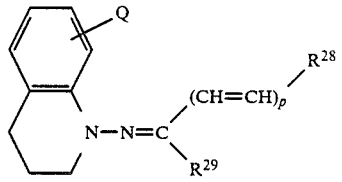

(wherein, $R^{28}$: represents a substituted or unsubstituted aryl group, or a substituted or unsubstituted heterocyclic group;

$R^{29}$: represents a hydrogen atom, a substituted or unsubstituted alkyl group, or a substituted or unsubstituted aryl group;

Q: represents a hydrogen atom, a halogen atom, an alkyl group, a substituted amino group, an alkoxy group, or a cyano-group;

P: represents an integer of 0 or 1.)

Examples of hydrazones having these general formulas [IV]-[VII] individually are given below:

(IV-1)

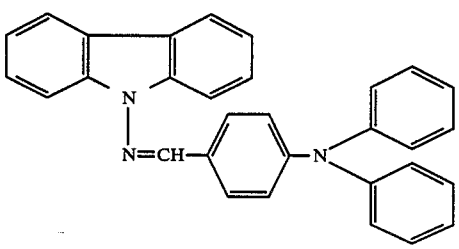

(IV-2)

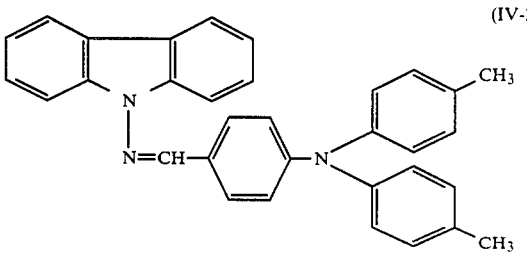

(IV-3)

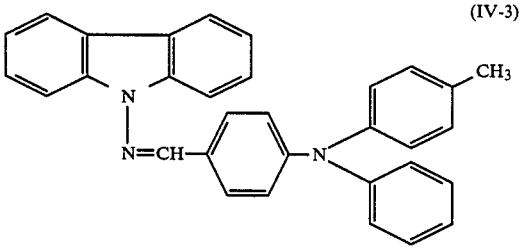

(IV-4)

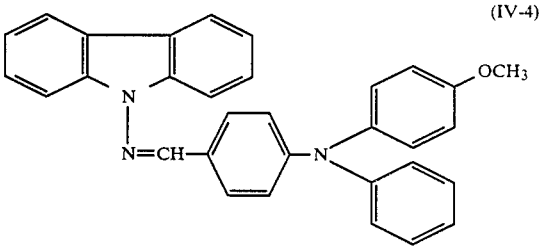

(IV-5)

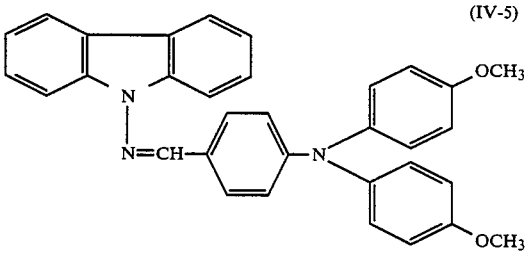

(IV-6)

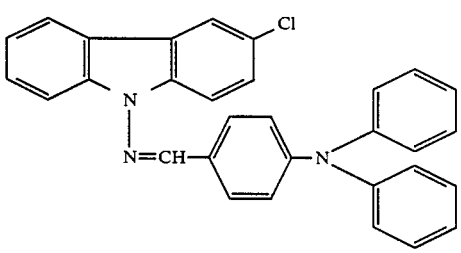

(V-1)

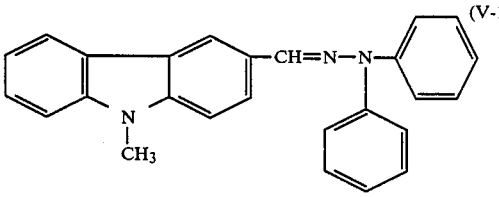

(V-2)

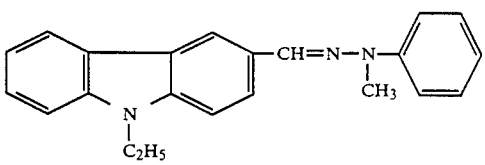

-continued
(V-3)
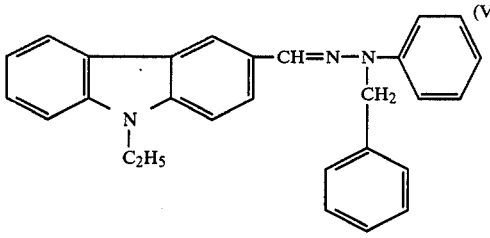
(VI-1)
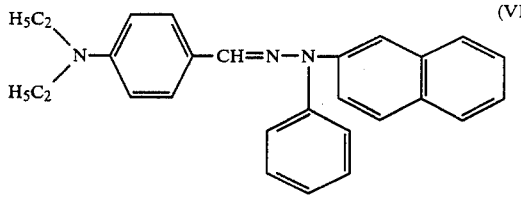
(VI-2)
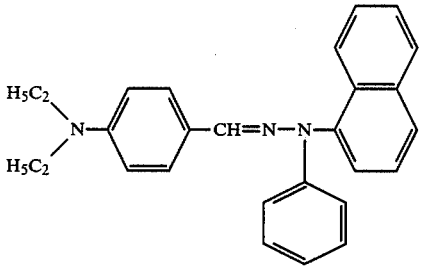
(VI-3)
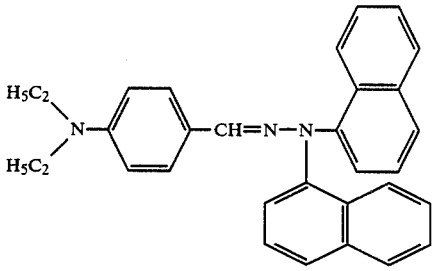
(VI-4)
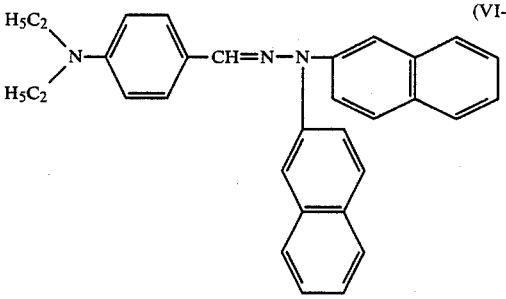
(VI-5)
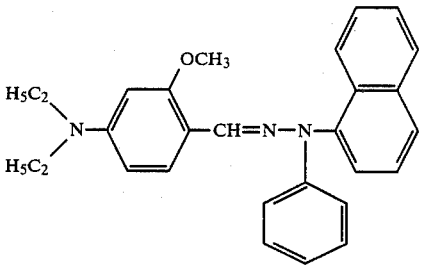
(VI-6)
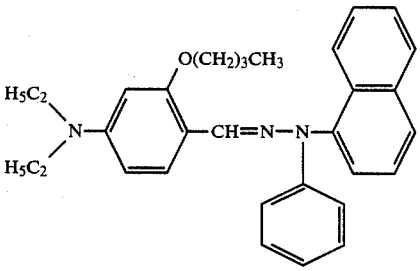
(VI-7)
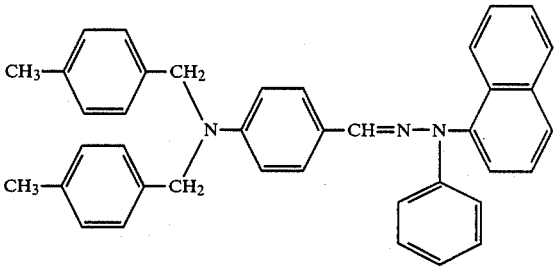
(VI-8)
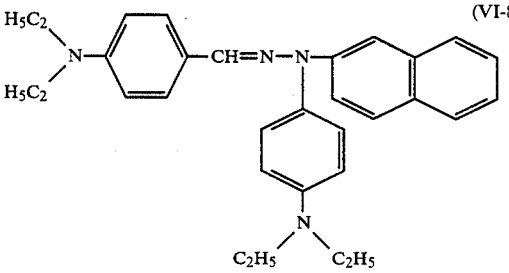
(VII-1)
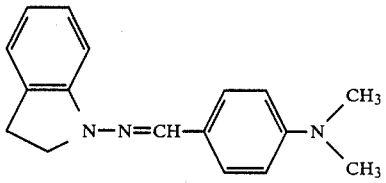
(VII-2)
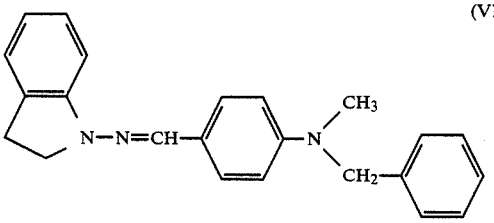
(VII-3)
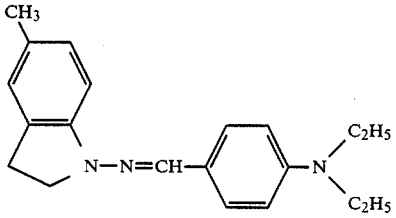

-continued
(VII-4)
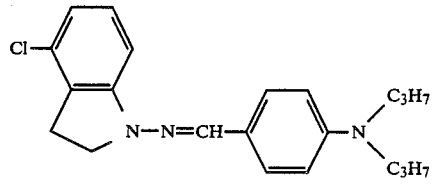
(VII-5)
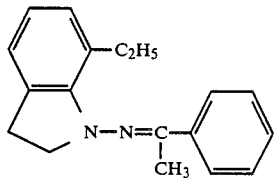
(VII-6)
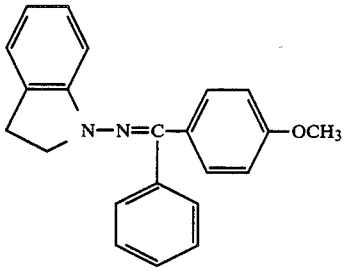
(VII-7)
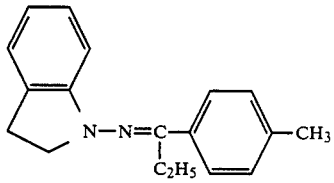
(VII-8)
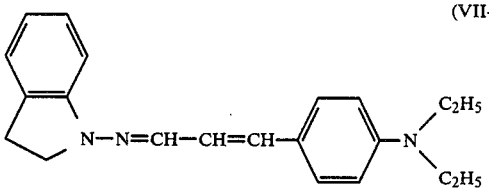
(VII-9)
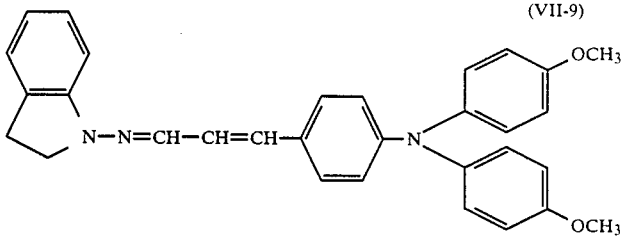
(VII-10)
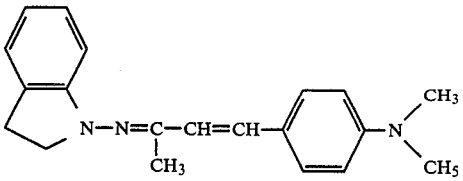
(VII-11)
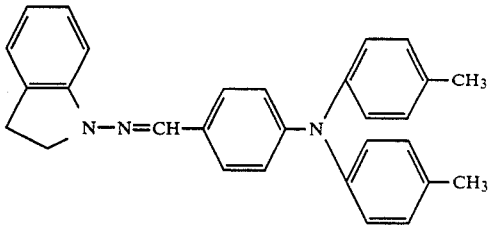
(VII-12)
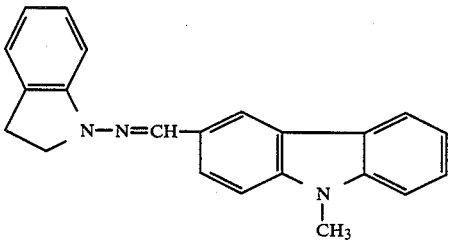
(VII-13)
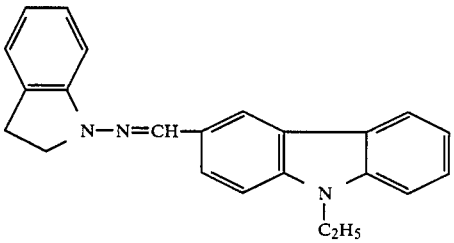
(VII-14)
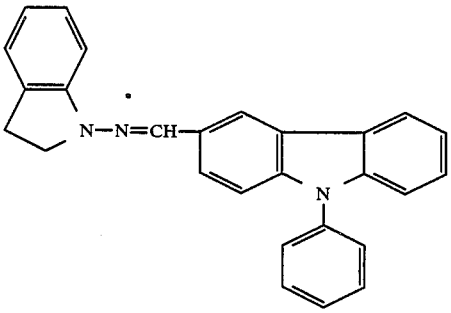
(VII-15)
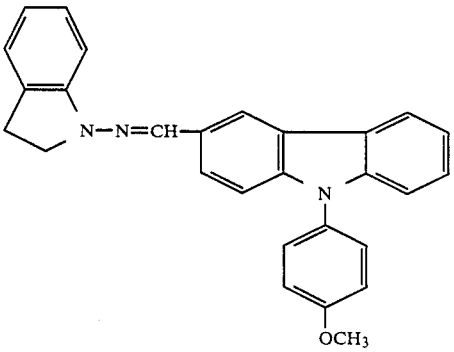

-continued
(VII-16)
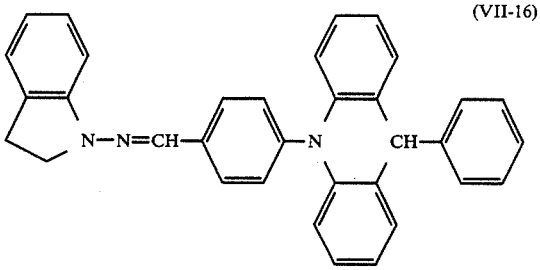
(VII-17)
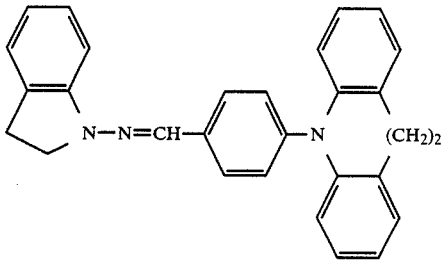
(VII-18)
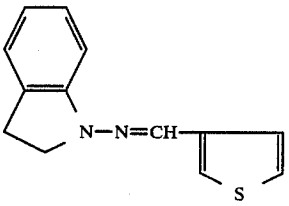
(VII-19)
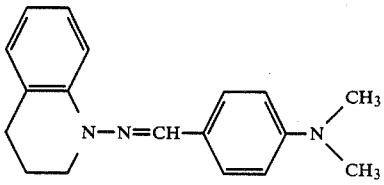
(VII-20)
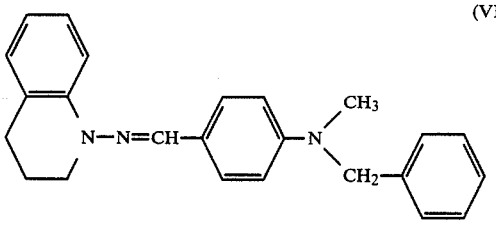
(VII-21)
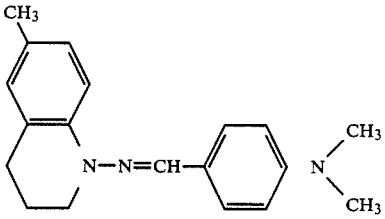
(VII-22)
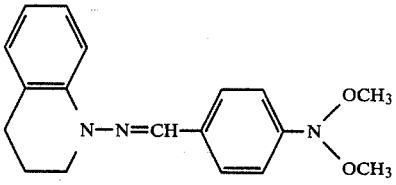
(VII-23)
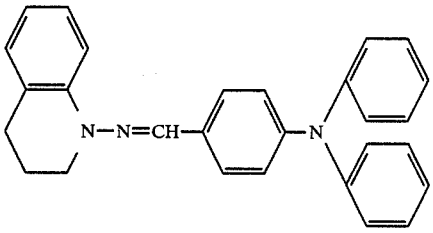
(VII-24)
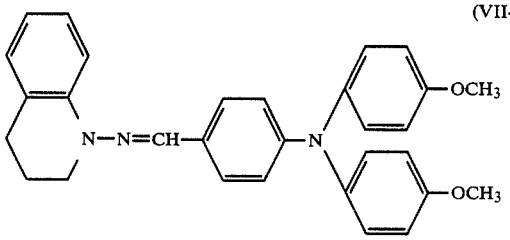
(VII-25)
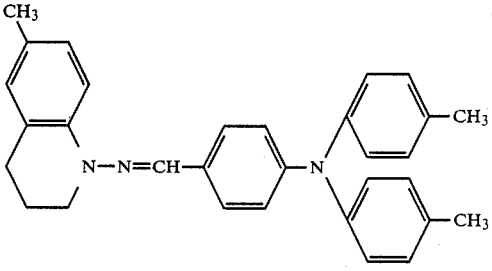
(VII-26)
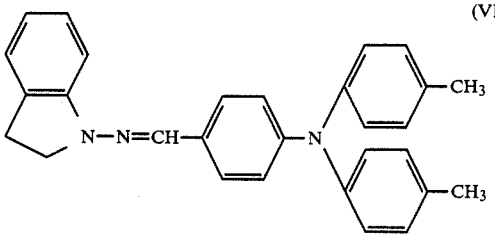
(VII-27)
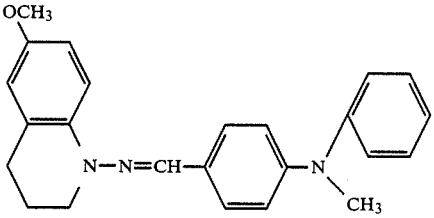

-continued
(VII-28)
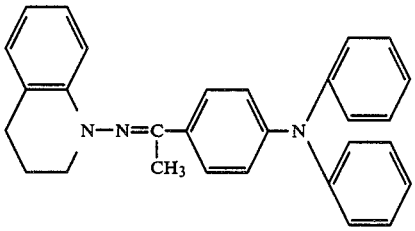
(VII-29)
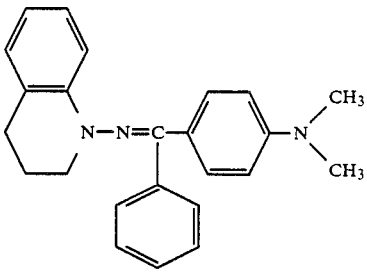
(VII-30)
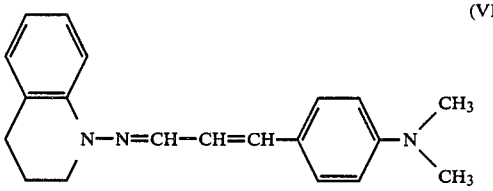
(VII-31)
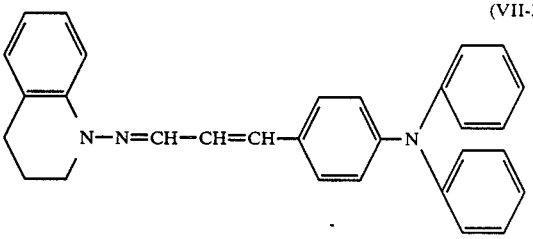
(VII-32)
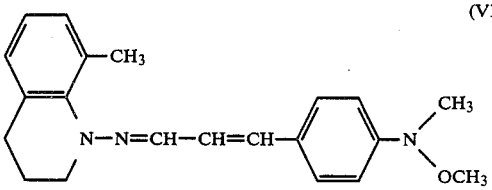
(VII-33)
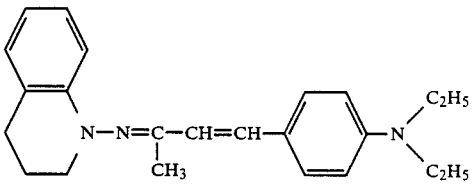
(VII-34)
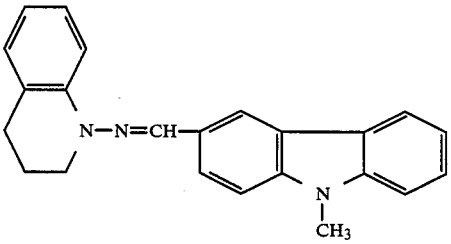
(VII-35)
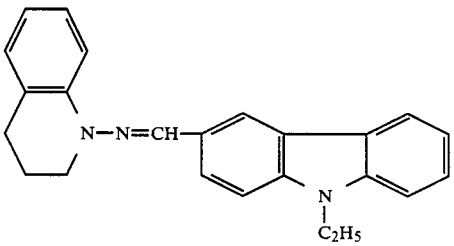
(VII-36)
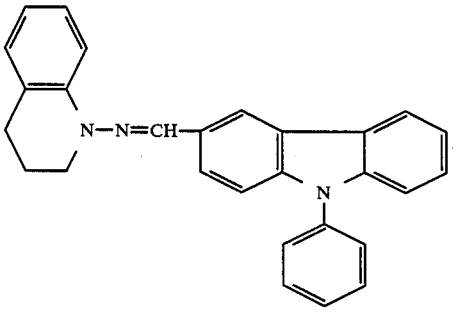
(VII-37)
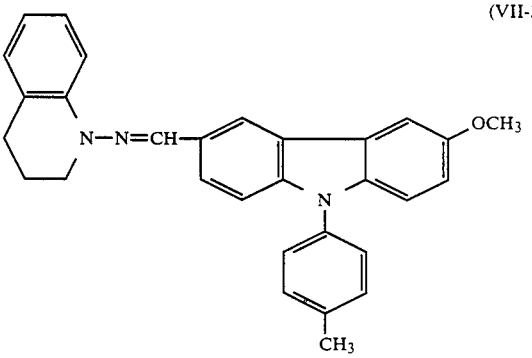
(VII-38)
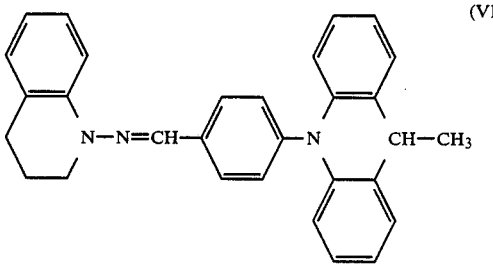
(VII-39)
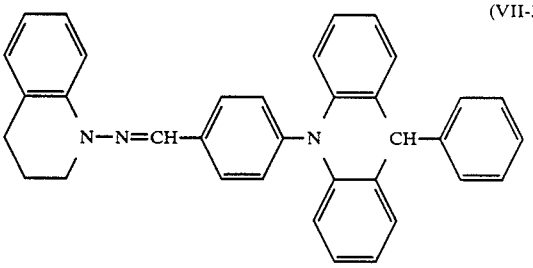

-continued (VII-40)

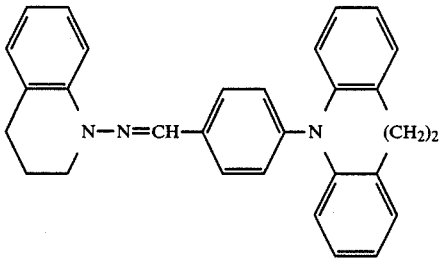

(VII-41)

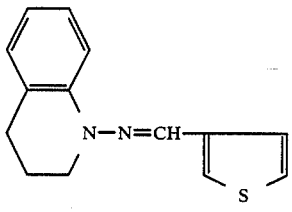

(VII-42)

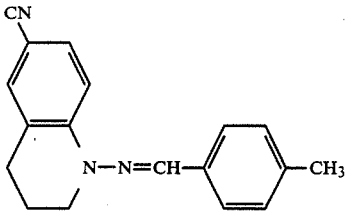

(VII-43)

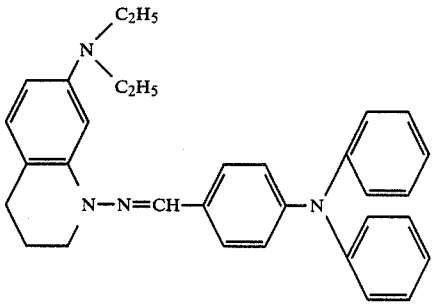

(VII-44)

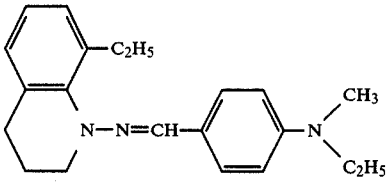

(VII-45)

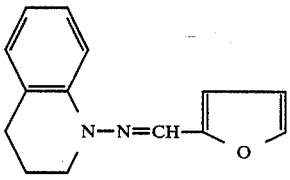

(VII-46)

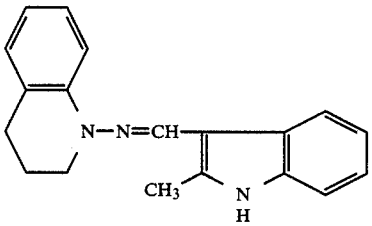

(VII-47)

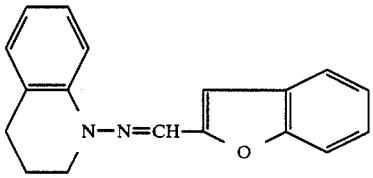

(VII-48)

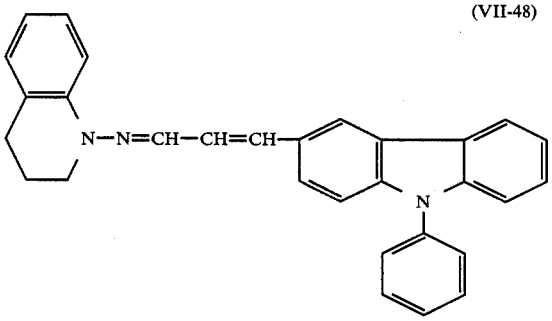

(VII-49)

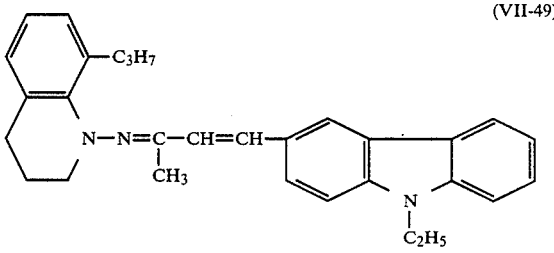

Figure 4:
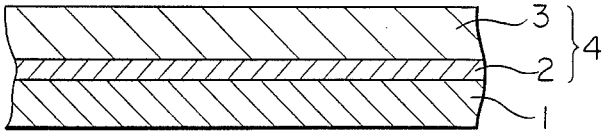
FIGS. 4, 5, 6, 7, 8 and 9 are schematic views showing various layer formations for the photoreceptor in accordance with the invention.
Figure 5:
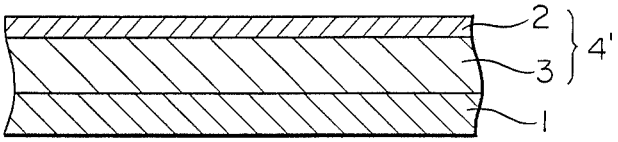
Figure 6:
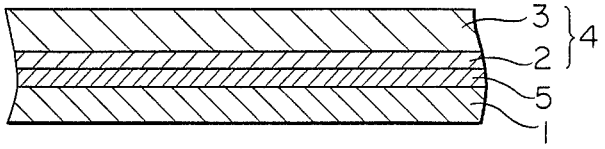
Figure 7:
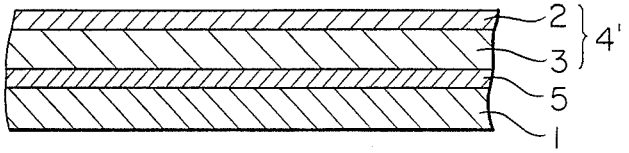
Figure 8:
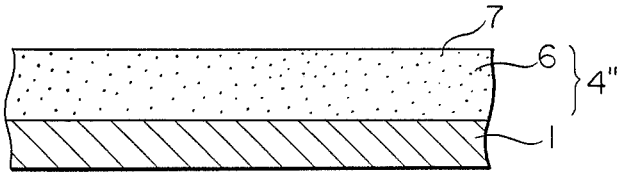
Figure 9:
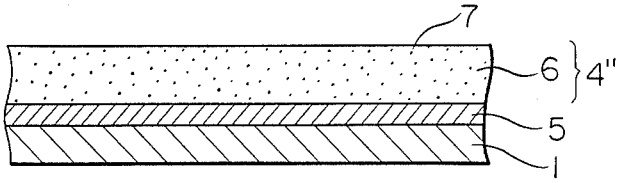

In order to form a photosensitive layer for the photoreceptor in accordance with the invention, the carrier generating substance and the carrier transport substance are used in combination either in a single layer, in which both substances are dispersed as a separated phase, or in separate layers as function separated photoconductive layers. Such layer is usually constructed as illustrated in FIGS. 4 to 9. FIG. 4 shows a photosensitive layer 4 comprising a carrier generating layer 2 containing a metal phthalocyanine compound and/or a metal-free phthalocyanine compound and formed on an electroconductive substrate 1, and a carrier transport layer 3 containing aforesaid carrier transporting substance and laid on the carrier generating layer 2. FIG. 5 shows another form of photosensitive layer 4' in which the relative position of the carrier generating layer 2 and the carrier transport layer 3 is reversed. In the layer construction shown in FIG. 6, an intermediate layer 5 is provided between the photosensitive layer 4 and the electroconductive substrate 1. FIG. 7 shows a still another form of layer construction, in which an intermediate layer 5 is provided between the photosensitive layer 4' and the electroconductive substrate 1 in order to prevent entry of free electrons from the substrate 1 into the photosensitive layer 4'. Each of the layer configurations shown in FIGS. 5 and 7 may be advantageously used as a positive-charge photoreceptor, and in this case, the carrier generating layer 2 may contain a carrier transport substance in combination with the carrier generating substance. FIG. 8 shows another layer construction in which a photosensitive layer 4" comprises a combination of a carrier generating substance 6 containing a metal phthalocyanine compound and/or a metal-free phthalocyanine compound with a carrier transport substance 7. FIG. 9 shows another layer construction, wherein an intermediate layer 5 is provided between the photosensitive layer 4" in FIG. 8 and the photoconductive substrate 1.

In the case of two-layer construction is formed, a carrier generating layer 2 may be provided according to the following practice:

(a) coating a solution which is prepared by dissolving a carrier generating substance in a suitable solvent or a solution which is prepared by adding a binder to and dissolving same into the first mentioned solution; or (b) coating of a dispersion which is prepared by pulverizing a carrier generating substance by means of a ball mill or a homomixer in a dispersing medium, and if required, adding a binder and dispersing the same therein.

In connection with the above operation, uniform dispersion may be effected if particles are dispersed under the action of ultrasonic waves.

Among the solvents or dispersing mediums available for use in carrier-generating layer formation are N,N-dimethylformamide, acetone, methylethyl ketone, cyclohexanone, benzene, toluene, xylene, chloroform, 1,2-dichloroethane, dichloromethane, tetrahydrofuran, dioxane, methanol, ethanol, isopropyl, alcohol, ethyl acetate, butyl acetate, and dimethyl sulfoxide.

Where a binder is used in the formation of a carrier generating layer or a carrier transport layer, the binder may be of any type, but for this purpose a high polymeric material which is hydrophobic and which is capable of forming an electrical insulating film having a high dielectric constant is particularly preferred. As polymeric materials useful as such the following may be mentioned: polycarbonate, polyester, methacrylate resin, acrylic resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinylcarbazole, and polyvinyl butyral.

These binders may be used either alone or in the form of a mixture of two or more kinds. The proportion of the carrier generating substance to the binder component may be 10~600% by weight, preferably 50~400% by weight, and the proportion of the carrier transport substance may be 10~500% by weight.

The thickness of a carrier generating layer 2 formed in this way is preferably 0.01~20 μm and more preferably, 0.05~5 μm. The thickness of a carrier transport layer is 2~100 μm, preferably 5~30 μm.

Where such carrier generating substance as above said is dispersed in forming a photosensitive layer, the substance should be pulverized to a mean particle diameter of less than 2 μm, preferably less than 1 μm. If the particle diameter is excessively large, no satisfactory dispersion into the layer may be obtained, and particles of the substance may partially protrude from the surface, resulting in a less smooth surface. This may sometimes be a cause of electrical discharge at such particle protrusions on the surface, or of toner particles depositing on those spots to cause so called toner filming. It appears that a carrier generating substance having good sensitivity of long-wavelength rays (~700 nm) can neutralize a surface charge through the generation of a thermal excitation carrier within the substance and that if the particle diameter of the substance is larger, such neutralization effect is greater.

With a view to further improving the sensitivity of the photosensitive layer and/or reducing a residual potential or possible fatigue during repeated use, it is possible to incorporate one or more kinds of electron acceptors into the photosensitive layer. The addition of such substance may be made in the following proportions by weight ratio: electron receptor substance 0.01~200 to carrier generating substance 100, preferably the former 0.1~100 to the latter 100.

The substrate 1 on which aforesaid photosensitive layer is provided may be a metallic sheet or a metallic drum, or a composite formed by laying an electroconductive film made of an electroconductive compound, such as electroconductive polymer or iridium oxide, or a metal, such as aluminum, paradium, or gold, on a base of such material as paper or plastic film by coating, deposition, lamination, or otherwise. For an intermediate layer which functions as a bonding layer or a barrier layer, any of such-high polymeric substances as referred to above as binder resins, or of organic polymeric substances such as polyvinyl alcohol, ethyl cellulose, and carboxymethyl cellulose, or of aluminum oxide may be used.

The photoreceptor in accordance with the invention is produced in above described manner. One advantage of the invention is that a carrier generating layer can be formed by coating without changing the crystal form of the carrier generating substance and free of any difficulty accompanied with the use of organic amines during and after coating. Another advantage is that the photoreceptor having a carrier generating layer thus formed can, by virtue of the organic amine used in combination with the phthalocyanine compound, efficiently prevent the development of the so-called memory phenomenon due to a drop in acceptance potential during darkdecay and repeated use. The principle of such advantageous effect that the organic amine is adsorbed by the carrier generating layer at acceptor sites therein, whereby the acceptor concentration is decreased, the electrical resistance of the carrier generating layer being thus enhanced, with the result of increased acceptance potential and decreased dark decay.

As above described, this invention uses organic amines in combination with a metal phthalocyanine compound and/or a metal free phthalocyanine compound, and accordingly it can provide a photoreceptor which is less subject to memory phenomenon, is much longer serviceable, and which has a long-wave photosensitive range suitable for use with long-wavelength light, and more particularly to semiconductor laser beams.

EXAMPLES

To further illustrate the invention, examples are presented below. Before the examples are described, however, a synthesis example for a metal-free phthalocyanine compound A having the characteristic shown in FIGS. 1 through 3, and a synthesis example for a $\tau$-type metal-free phthalocyanine compound are first given.

SYNTHESIS EXAMPLE 1

Fifty grams of a lithium phthalocyanine compound are added to 600 ml of concentrated sulfuric acid, thoroughly stirred, at 0° C. The mixture is then stirred for 2 hours at same temperature. The resulting solution is filtered through a coarse sintered funnel and is gradually poured under stirring into 4 l of ice and water. After being allowed to stand for a few hours, the mixture is filtered and the resulting solid mass is washed until it is neutralized. Subsequently, the solid mass is finally washed in methanol and dried in air. The dried powdery mass is subjected to extraction by acetone in a continuous extracting apparatus for 24 hrs and dried in air, being thus turned out into a blue powdery mass.

In the above process, separating is repeated in order to assure a salt residue for the lithium. In this way, 30.5 g of blue powder was obtained. The product thus obtained was in agreement with an X-ray diffraction pattern shown in a published material.

Thirty grams of the metal-free $\alpha$-type phthalocyanine compound thus obtained was charged into a porcelain ball mill having an internal volume of 900 ml which was half filled with balls of 13/16 inch dia, and was subjected to milling at about 80 rpm for 164 hrs. Subsequently, 200 ml of organic solvents, such as tetrahydrofuran and 1,2-dichloroethane, were added into the ball mill, and again the mixture were subjected to milling for 24 hrs. Organic solvent removal and drying were effected with the post-milling dispersion, and 28.2 g of an X-type metal-free phthalocyanine compound were obtained.

SYNTHESIS EXAMPLE 2

An $\alpha$-type metal-free phthalocyanine compound ("Monolite Fastbull GS" produced by ICI) was subjected to extraction by dimethylformaldehyde three times and the product was refined. Through this operation the refined product was transformed into $\alpha$-type. Then a part of the $\beta$-type metal-free phthalocyanine compound was dissolved in concentrated sulfuric acid, and the resulting solution was poured into iced water and allowed to reprecipitate, whereby it was transformed into $\alpha$-type. The reprecipitate was washed in aqueous ammonia, methanol or the like, and was then dried at 10° C. Then, the $\alpha$-type metal-free phthalocyanine compound, together with a grinding assistant and a dispersant, was placed into a sandmill and the mixture was kneaded at 100±20° C. for 15~25 hrs. It was confirmed that the crystal form was changed to $\tau$-type configuration through this process, and thereafter the material was removed from the vessel. After the grinding assistant and dispersant were thoroughly removed, the product was dried and a blue crystal form of $\tau$-type metal-free phthalocyanine compound having a clear bluing effect was obtained.

EXAMPLE 1

On a electroconductive substrate consisting of a polyester film with aluminum deposited thereon was dispersed by a ultrasonic dispersion technique a combination of 1.0 g of metal-free phthalocyanine compound obtained in Synthesis Example 1 and 2.0 g of polymethyl methacrylate ("Elvacite—2010", produced by DuPont) added to 100 ml of 1,2-dichloroethane. A carrier generating layer was formed by coating and drying the dispersion so that the post-drying coat thickness of the dispersion would be 0.5 $\mu$m.

Again, on top of the layer was effected coating of a solution prepared by dissolving 12.4 g of a carrier transport substance as shown in Table 2 and 16.5 g of polycarbonate ("Panlite L-1250, produced by Teijin Limited) in 100 ml of 1,2-dichloroethane, the coating being followed by drying, so that the post-drying coat thickness would be 12 $\mu$m, whereby a carrier transport layer was formed. Thus, a photoreceptor for electrophotography was obtained.

EXAMPLES 2~6

Photoreceptors were obtained in Example 2~6 in same way as in Example 1, except that the materials mentioned under corresponding columns for Examples 2~6 in Table 2 were respectively used instead of those used in Example 1.

COMPARATIVE EXAMPLES 1 and 2

Photoreceptors were obtained in Comparative Examples 1 and 2 in same manner as in Example 1, except that the materials mentioned under corresponding columns for Comparative Examples 1 and 2 in Table 2 were used instead of those used in Example 1.

COMPARATIVE EXAMPLES 3 and 4

Photoreceptor for electrophotography were obtained in Comparative Examples 3 and 4 in same manner as in Example 1, except that the $\tau$-type phthalocyanine compound of Synthesis Example 2 was used in Example 1 and that the carrier transport substances mentioned under corresponding columns for Comparative Examples 3 and 4 in Table 2 were used in Comparative Examples 3 and 4.

EVALUATION TESTS

Each of the photoreceptors for electrophotography which were thus obtained was tested by "Electrometer SP428" (made by Kawaguchi Denki Seisakusho) for its electrophotographic characteristics. Measurements were made of: reception potential $V_A$ (V) when the surface of the photoreceptor was electrified at static charge voltage −6 kV for 6 sec; exposure $E\frac{1}{2}$ (Lux. sec) (tungsten light used) required for attenuating to $\frac{1}{2}$ the potential $V_1$ (initial potential) following a 5 sec dark decay; darkdecay ratio $(V_A-V_1)/V_1\times 100\%$; and a residual potential $V_R$ (V) after 10 (Lux. sec) exposure.

Next, in same measurement system, measurement was made of half-reduced exposure $E_{\frac{1}{2}}(\lambda=780)$ (erg/cm$^2$) to light rays of wave length 780 nm±1 nm in particular, by using tungsten light as a light source and via a monochromator. Measurements were also made with respect to aforesaid reception potential $V_A$ (V) and residual potential after 10,000 cycles of copying.

Results of these measurements are shown in Table 3. In the table, $\Delta V_A$, $\Delta V_R$ denote values for respective initial characteristic values less corresponding characteristic values after 10,000 time copying.

TABLE 2

| | Carrier generating layer | | Carrier transport layer | | Kind of amine and addition thereof (molar ratio) |
|---|---|---|---|---|---|
| | Carrier generating substance | Binder | Carrier transport substance | Binder | |
| Example | | | | | |
| 1 | Metal-free phthalocyanine in Synthesis Example 1 | Polymethyl methacrylate | Compound in II-26 above | Polycarbonate | Di-iso-butyl amine 0.005 |
| 2 | Metal-free phthalocyanine in Synthesis Example 1 | Polymethyl methacrylate | Compound in II-26 above | Polycarbonate | Di-iso-butyl amine 0.01 |
| 3 | Metal-free phthalocyanine in Synthesis Example 1 | Polymethyl methacrylate | Compound in II-26 above | Polycarbonate | Di-iso-butyl amine 0.05 |
| 4 | Metal-free phthalocyanine in Synthesis Example 1 | Polymethyl methacrylate | Compound in II-26 above | Polycarbonate | Di-iso-butyl amine 0.2 |
| 5 | Metal-free phthalocyanine in Synthesis Example 1 | Polymethyl methacrylate | Compound in II-26 above | Polycarbonate | Di-iso-butyl amine 2.0 |
| Comparative Example | | | | | |
| 1 | Metal-free phthalocyanine in Synthesis Example 1 | Polymethyl methacrylate | Compound in II-26 above | Polycarbonate | Di-iso-butyl amine 5.0 |
| 2 | Metal-free phthalocyanine in Synthesis Example 1 | Polymethyl methacrylate | Compound in II-26 above | Polycarbonate | Di-iso-butyl amine 0.0005 |
| Example | | | | | |
| 6 | Metal-free phthalocyanine in Synthesis Example 1 | Polymethyl methacrylate | Compound in VII-13 above | Polycarbonate | Tributyl amine 0.05 |
| 7 | Metal-free phthalocyanine in Synthesis Example 1 | Polymethyl methacrylate | Compound in VII-13 above | Polycarbonate | Tributyl amine 0.1 |
| 8 | $\tau$-type phthalocyanine produced in.Synthesis Example 2 | Polymethyl methacrylate | Compound in XI below | Polycarbonate | Monoethanol amine 0.05 |
| 9 | $\tau$-type phthalocyanine produced in Synthesis Example 2 | Polymethyl methacrylate | Compound in XI below | Polycarbonate | Monoethanol amine 0.1 |

TABLE 3

| | Initial characteristics | | | | | Characteristic value after 10,000 time copying | | Change | |
|---|---|---|---|---|---|---|---|---|---|
| | $E_{\frac{1}{2}}$ (lux sec) | $V_A$ (V) | $V_R$ (V) | Dark-decay ratio (%) | $E_{\frac{1}{2}}$ ($\lambda$ = 780 nm) (erg/cm$^2$) | $V_A$ (V) | $V_R$ (V) | $\Delta V_A$ (V) | $\Delta V_R$ (V) |
| Example | | | | | | | | | |
| 1 | 0.86 | −810 | 0.0 | 13 | 4.7 | −779 | −12 | −21 | +12 |
| 2 | 0.85 | −810 | 0.0 | 12 | 4.6 | −778 | −12 | −22 | +12 |
| 3 | 0.86 | −800 | 0.0 | 12 | 4.6 | −782 | −11 | −18 | +11 |
| 4 | 0.90 | −800 | 0.0 | 12 | 4.6 | −780 | −10 | −20 | +10 |
| 5 | 1.00 | −800 | 0.0 | 12 | 4.8 | −820 | −12 | +20 | +12 |
| Comparative Example | | | | | | | | | |
| 1 | 1.80 | −820 | −10 | 10 | 7.2 | −870 | −100 | +50 | +90 |
| 2 | 0.90 | −810 | −30 | 16 | 4.8 | −750 | −20 | −50 | +20 |
| Example | | | | | | | | | |
| 6 | 1.20 | −800 | 0.0 | 12 | 5.0 | −780 | −11 | −20 | +11 |
| 7 | 1.20 | −800 | 0.0 | 12 | 5.0 | −778 | −11 | −22 | +11 |
| 8 | 1.30 | −800 | 0.0 | 12 | 5.2 | −780 | −12 | −20 | +12 |

TABLE 3-continued

| | Initial characteristics | | | | | Characteristic value after 10,000 time copying | | Change | |
|---|---|---|---|---|---|---|---|---|---|
| | $E_{\frac{1}{2}}$ (lux sec) | $V_A$ (V) | $V_R$ (V) | Dark-decay ratio (%) | $E_{\frac{1}{2}}$ ($\lambda$ = 780 nm) (erg/cm$^2$) | $V_A$ (V) | $V_R$ (V) | $\Delta V_A$ (V) | $\Delta V_R$ (V) |
| 9 | 1.20 | −810 | 0.0 | 12 | 5.1 | −792 | −10 | −18 | +10 |

What is claimed is:

1. A photoreceptor for electrophotography comprising a substrate, at least one carrier generating substance and at least one carrier transporting substance, both of which substances are incorporated in at least one layer provided on said substrate, characterised in that at least one of said carrier generating substance is a metal phthalocyanine compound or a metal-free phthalocyanine compound, and the layer containing said at least one carrier generating substance comprises an organic amine compound in a quantity of 2.0 to 0.001 times as much as said carrier generating substance in terms of mole number.

2. The photoreceptor of claim 1, wherein said organic amine is contained in a quantity of not more than 0.2 times as much as said carrier generating substance in terms of mole number.

3. The photoreceptor of claim 1, wherein said carrier generating material is selected from a group consisting of $\alpha$-, $\beta$-, $\gamma$-, $\tau'$-, $\eta$-, $\eta'$- and $\chi$-type metal-free phthalocyanine compounds, and $\epsilon$-type copper phthalocyanine compounds.

4. The photoreceptor of claim 3, wherein said carrier generating material is selected from a group consisting of $\tau$-, $\tau'$-, $\eta$-, $\eta'$- and $\chi$-type metal-free phthalocyanine compounds, and $\epsilon$-type copper phthalocyanine compounds.

5. The photoreceptor of claim 3, wherein said carrier generating material is selected from $\epsilon$-type copper phthalocyanine compounds.

6. The photoreceptor of claim 1, wherein said organic amine compound has a boiling point of not less than 80° C.

7. The photoreceptor of claim 6, wherein said organic amine compound is selected from a group consisting of monoethanol amine, ethylenediamine, isopropylamine, octylamine, methylamine, ethylamine, cyclohexyl amine, tert-butyl amine, sec-butyl amine, n-butyl amine, n-amyl amine, propylamine, n-heptyl amine, diethanol amine, diethylamine, piperidine, di-n-propyl amine, dimethylamine, dihexylamine, didodecylamine, di-1-butyl amine, di-1-amylamine, di-octyl amine, di-cyclohexyl amine, di-amyl amine, di-n-butyl amine, di-isopropyl amine, tri-propylamine, triethylamine, n-tributyl amine, triamylamine, triethanol amine and pyridine.

8. The photoreceptor of claim 6, wherein said organic amine compound is a secondary or tertiary amine.

9. The photoreceptor of claim 8, wherein said organic amine compound is selected from a group consisting of diethanol amine, diethylamine, piperidine, di-n-propyl amine, dihexylamine, didodecylamine, di-1-butyl amine, di-1-amylamine, di-octyl amine, di-n-butyl amine, di-isopropyl amine.

10. The photoreceptor of claim 1, wherein said carrier generating substance is selected from a compound represented by the general formula [II], [III] or [VII]:

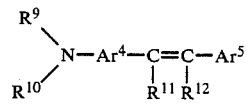

[II]

(wherein, $R^9$ and $R^{10}$ independently represent an alkyl group or an aryl group which may have a substituent selected from an alkyl group an alkoxy group, a substituted amino group, a hydrxy group an aryl group and a halogen atom);

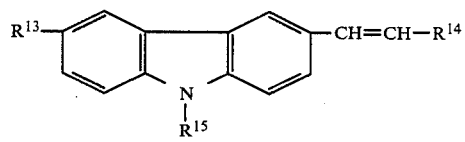

[III]

(wherein, $R^{13}$ is an aryl group which may have a substituent, $R^{14}$ is selected from a hydrogen atom, a halogen atom, an alkyl group, an alkoxy group, an amino group and a hydroxy group provided that these groups herein mentioned may have a substituent);

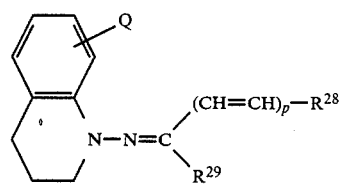

[VII]

(wherein $R^{28}$ is selected from an aryl group and a heterocyclic group, each of which groups may have a substituent; $R^{29}$ is selected from a hydrogen atom, an alkyl group and an aryl group, each of which groups may have a substituent; Q is selected from a hydrogen atom, a halogen atom, an alkyl group, a substituted amino group, an alkoxy group and a cyano group; and p is an integer of 0 or 1.).

11. The photoreceptor of claim 1, wherein said carrier generating substance and said carrier transporting substance are incorporated in a same layer.

12. The photoreceptor of claim 1, wherein said carrier generating substance and said carrier transporting substance are respectively incorporated in separate layers.

13. The photoreceptor of claim 12, wherein said photoreceptor has a layer structure comprising (i) said substrate and provided thereon (ii) said layer containing said carrier generating substance, and (iii) said layer containing said carrier transporting substance.

14. The photoreceptor of claim 11, wherein said photoreceptor comprises an intermediate layer between said substrate and said layer containing carrier generating substance and said carrier transporting substance.

15. The photoreceptor of claim 13, wherein said photoreceptor has a layer structure comprising (i) said substrate, (ii) said layer containing said carrier generating substance, and (iii) said layer containing said carrier transporting substance in this order.

16. The photoreceptor of claim 13, wherein said photoreceptor has a layer structure comprising (i) said substrate, (ii) said layer containing said carrier transporting substance, and (iii) said layer containing said carrier generating substance in this order.

17. The photoreceptor of claim 15, wherein said photoreceptor comprises an intermediate layer between said substrate and said layer containing said carrier generating substance.

18. The photoreceptor of claim 16, wherein said photoreceptor comprises an intermediate layer between said substrate and said layer containing said carrier transporting substance.

* * * * *